US012715550B1

(12) United States Patent
Berman et al.

(10) Patent No.: US 12,715,550 B1
(45) Date of Patent: Aug. 25, 2026

(54) REVERSIBLE SEAT SYSTEM FOR BOATS

(71) Applicant: CHRIS-CRAFT CORPORATION, Sarasota, FL (US)

(72) Inventors: Ronald M. Berman, Palmetto, FL (US); John Duncan Isiminger, Bradenton, FL (US)

(73) Assignee: CHRIS-CRAFT CORPORATION, Sarasota, FL (US)

( * ) Notice: Subject to any disclaimer, the term of this patent is extended or adjusted under 35 U.S.C. 154(b) by 1001 days.

(21) Appl. No.: 17/838,398

(22) Filed: Jun. 13, 2022

Related U.S. Application Data

(60) Provisional application No. 63/215,650, filed on Jun. 28, 2021.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS

| | | | | |
|---|---|---|---|---|
| 250,597 | A | 12/1881 | St. John | |
| 427,413 | A | 5/1890 | Fritz | |
| 831,877 | A | 9/1906 | Kling | |
| 1,224,982 | A | 5/1917 | Washeim | |
| 1,271,830 | A | 7/1918 | Austin | |
| 1,782,231 | A | 11/1930 | William et al. | |
| 1,792,737 | A | 2/1931 | Milfred | |
| 2,076,309 | A | 4/1937 | Grand | |
| 2,113,346 | A | 4/1938 | Frederick | |
| 2,480,552 | A * | 8/1949 | Colvez | A47C 1/028 297/411.27 |
| 2,486,468 | A | 11/1949 | Freedman | |
| 2,900,009 | A | 8/1959 | Haynes | |
| 2,969,107 | A | 1/1961 | Ira et al. | |
| 3,107,940 | A | 10/1963 | Brooks et al. | |
| 3,379,471 | A | 4/1968 | Dalziel | |
| 3,482,870 | A | 12/1969 | Janssen | |
| 3,506,303 | A | 4/1970 | Smittle | |
| 3,643,528 | A | 2/1972 | Van Der Loos | |
| 3,743,350 | A | 7/1973 | Allen | |
| 3,839,757 | A | 10/1974 | Grimes | |
| 3,877,747 | A | 4/1975 | Brennan | |
| 3,884,522 | A | 5/1975 | Arima et al. | |

(Continued)

FOREIGN PATENT DOCUMENTS

| | | |
|---|---|---|
| CN | 109693587 | 3/2021 |
| DE | 19501521 | 7/1995 |

(Continued)

*Primary Examiner* — Marc Q Jimenez
*Assistant Examiner* — Jovon E Hayes
(74) *Attorney, Agent, or Firm* — Faegre Drinker Biddle & Reath LLP

(57) ABSTRACT

Reversible seat systems for boats, methods of using the reversible seat systems, and boats including the reversible seat systems are described herein. The reversible seat systems described herein can be moved between a forward-facing configuration and aft-facing configuration by rotating a seat of the seat system about a seat axis generally aligned with the deck of a boat on which the seat system is mounted.

27 Claims, 7 Drawing Sheets

(56) References Cited

U.S. PATENT DOCUMENTS 4,030,436 A 6/1977 Stoberl
4,088,040 A 5/1978 Ross-Myring
4,099,768 A 7/1978 Amos
4,536,027 A 8/1985 Brennan
4,558,901 A 12/1985 Yokoyama
4,567,845 A 2/1986 Smith
4,693,204 A 9/1987 Klein
4,736,982 A 4/1988 Hwang
4,738,217 A 4/1988 Smith
4,775,187 A 10/1988 Herr
4,843,999 A 7/1989 Kobus et al.
4,854,261 A 8/1989 Goldsmith
4,926,783 A 5/1990 Lathers
5,052,076 A 10/1991 Spaeth
5,052,748 A 10/1991 Fourrey et al.
5,054,857 A 10/1991 Kvalheim
5,107,720 A 4/1992 Hatfield
5,136,963 A 8/1992 Zuzik
5,171,064 A 12/1992 Boussaroque
5,195,795 A 3/1993 Cannera et al.
5,261,727 A 11/1993 Klaebel
5,313,033 A 5/1994 Link et al.
5,320,059 A 6/1994 Ikeda
5,328,239 A * 7/1994 Yamazaki ..... B60N 2/3065 297/333
5,329,871 A 7/1994 Gibbs
5,374,108 A 12/1994 Saul et al.
5,375,907 A 12/1994 Rogers et al.
5,381,585 A 1/1995 Olson et al.
5,531,506 A 7/1996 Scott
5,553,920 A 9/1996 Meschkat et al.
5,613,662 A 3/1997 Blackmore
5,762,402 A 6/1998 Gillotti
5,782,534 A 7/1998 Desanta
5,799,605 A 9/1998 Huse
5,842,743 A 12/1998 Wright et al.
5,904,401 A 5/1999 Alberda et al.
5,913,571 A 6/1999 Dystra et al.
5,976,160 A 11/1999 Crainich
6,196,629 B1 3/2001 Onishi et al.
6,230,648 B1 5/2001 Davidson et al.
6,257,667 B1 7/2001 Boren et al.
6,283,059 B1 9/2001 Scully, Jr.
6,527,341 B1 3/2003 Martin
D481,986 S 11/2003 Menne
6,647,916 B2 11/2003 Neese et al.
6,766,759 B2 7/2004 Eck et al.
6,789,494 B2 9/2004 Neese et al.
6,866,022 B1 3/2005 Phillips et al.
6,880,482 B2 4/2005 Huse
6,883,458 B2 4/2005 Huse
6,918,160 B1 7/2005 Clark
6,940,026 B2 9/2005 Rundell et al.
6,945,190 B1 9/2005 Frandsen
7,000,557 B1 2/2006 Forbes et al.
7,107,927 B2 9/2006 Hopper et al.
7,121,218 B2 10/2006 Stinson et al.
7,156,442 B2 1/2007 McManus et al.
7,172,252 B2 2/2007 Hennins
7,252,336 B2 * 8/2007 Frisina ..... B60N 2/1839 297/130
7,255,058 B2 8/2007 Forbes et al.
7,302,906 B2 12/2007 Burroughs et al.
7,341,018 B2 3/2008 Greenberg et al.
7,341,306 B1 3/2008 Neese et al.
7,367,616 B2 * 5/2008 Summerford ..... A47C 9/06 297/14
7,416,238 B2 * 8/2008 Houston ..... B60N 2/36 296/66
7,422,279 B2 9/2008 Kushner et al.
7,513,211 B1 4/2009 Farb et al.
7,647,880 B2 * 1/2010 Devine ..... B63B 29/04 297/452.4
7,661,382 B2 2/2010 Wood et al.
7,677,668 B2 3/2010 Olsen et al.
7,699,390 B2 4/2010 Baumann
7,819,483 B2 10/2010 Kushner et al.
7,828,383 B1 11/2010 Urbanek et al.
8,002,350 B2 8/2011 Johnson
8,028,641 B1 10/2011 Sly
8,038,206 B2 10/2011 Ito et al.
8,109,563 B2 2/2012 Hansen
8,113,136 B2 2/2012 Mayrand et al.
8,113,137 B2 2/2012 Thompson
8,113,589 B2 2/2012 Mildt et al.
8,376,443 B2 2/2013 Kemp et al.
8,499,377 B2 8/2013 Fafard et al.
8,517,466 B1 8/2013 Wizorek et al.
8,720,990 B2 5/2014 Boydston
8,740,297 B1 6/2014 Foss et al.
8,801,099 B2 8/2014 Ebel et al.
8,840,175 B2 9/2014 Short
8,899,169 B1 12/2014 Jaziri
9,021,975 B1 5/2015 Fodor et al.
9,067,517 B1 6/2015 Roeglin et al.
9,073,608 B1 7/2015 Foss et al.
D743,318 S 11/2015 Curts
9,260,166 B1 2/2016 Fodor et al.
9,315,238 B2 4/2016 Neese et al.
9,370,245 B2 6/2016 Fafard et al.
9,403,597 B2 8/2016 Ferry et al.
9,440,560 B2 9/2016 Neese et al.
9,487,273 B1 11/2016 Eekhoff et al.
9,527,555 B2 12/2016 Ketterman et al.
9,650,117 B2 5/2017 Curts et al.
9,688,168 B2 6/2017 Gratz
9,701,368 B2 7/2017 Neese et al.
D794,537 S 8/2017 Wagnon
9,783,271 B2 10/2017 Foss et al.
9,821,887 B1 11/2017 Wilson
9,907,404 B1 3/2018 Sorel et al.
9,919,625 B1 3/2018 Barbier et al.
D819,540 S 6/2018 Wilson et al.
10,005,380 B2 6/2018 Reid et al.
D824,836 S 8/2018 Deurr
10,065,711 B2 9/2018 Fuller, IV et al.
10,065,713 B2 9/2018 Murphy
D830,944 S 10/2018 Deurr
10,085,566 B1 10/2018 Gallant
10,149,544 B2 12/2018 Fafard et al.
10,150,539 B1 12/2018 Wilson et al.
10,207,776 B1 2/2019 Downey et al.
10,328,836 B2 6/2019 Purwin et al.
10,422,167 B2 9/2019 Medina Huerta et al.
D864,081 S 10/2019 Barbier et al.
10,464,639 B2 11/2019 Neese et al.
10,471,859 B2 11/2019 Harrison, III et al.
10,479,233 B2 11/2019 Minato et al.
10,486,777 B1 11/2019 Barbier et al.
D870,016 S 12/2019 Wilson et al.
10,494,061 B2 12/2019 Fafard et al.
10,556,645 B1 2/2020 Levin
10,569,841 B2 2/2020 Fuller, IV et al.
10,759,502 B2 9/2020 Fafard et al.
10,933,774 B2 3/2021 Curts
11,034,414 B1 6/2021 Wilson et al.
11,174,893 B1 11/2021 Freer et al.
11,195,368 B2 12/2021 Patel et al.
11,286,022 B1 * 3/2022 Freer ..... B63B 29/04
12,258,100 B1 * 3/2025 De Luca ..... B63B 29/04
12,312,049 B2 * 5/2025 Curts ..... B63B 34/00
2003/0197402 A1 10/2003 McCutcheon et al.
2003/0218369 A1 11/2003 Akaike et al.
2006/0103174 A1 5/2006 Queveau et al.
2007/0114819 A1 5/2007 Dougherty
2007/0158986 A1 7/2007 Adams et al.
2008/0196649 A1 8/2008 Kalil
2008/0236452 A1 10/2008 Pratt et al.
2009/0261629 A1 10/2009 Fafard et al.
2009/0277372 A1 11/2009 Wood et al.
2010/0018451 A1 1/2010 Sahr
2010/0037813 A1 2/2010 Sahr et al.
2010/0037814 A1 2/2010 Sahr et al.

(56) References Cited

U.S. PATENT DOCUMENTS

| | | | | |
|---|---|---|---|---|
| 2010/0201163 | A1 | 8/2010 | Dunkel | |
| 2011/0057483 | A1 | 3/2011 | Dickey et al. | |
| 2011/0109136 | A1 | 5/2011 | Fafard et al. | |
| 2011/0226900 | A1 | 9/2011 | Bamford et al. | |
| 2014/0216327 | A1 | 8/2014 | Chen | |
| 2014/0265500 | A1 | 9/2014 | Hough et al. | |
| 2016/0152169 | A1 | 6/2016 | Zheng et al. | |
| 2017/0233042 | A1 | 8/2017 | Curts et al. | |
| 2019/0104849 | A1 | 4/2019 | Fafard et al. | |
| 2020/0331365 | A1* | 10/2020 | Curts | B60N 2/203 |
| 2020/0337467 | A1 | 10/2020 | Cannon | |
| 2020/0398944 | A1 | 12/2020 | Fafard et al. | |
| 2021/0169229 | A1 | 6/2021 | Niemela et al. | |
| 2021/0214052 | A1 | 7/2021 | Mast | |
| 2022/0258835 | A1 | 8/2022 | Curts et al. | |
| 2024/0359777 | A1* | 10/2024 | Schultz | B63B 32/83 |

FOREIGN PATENT DOCUMENTS

| | | |
|---|---|---|
| DE | 60207263 | 7/2006 |
| DE | 102011086751 | 5/2013 |
| GB | 635957 | 4/1950 |
| WO | 2019222749 | 11/2019 |

* cited by examiner

REVERSIBLE SEAT SYSTEM FOR BOATS

RELATED APPLICATION

This application claims the benefit under 35 U.S.C. Section 119 of U.S. Provisional Patent Application Ser. No. 63/215,650 entitled "REVERSIBLE SEAT SYSTEM FOR BOATS" filed on Jun. 28, 2021, which is incorporated herein by reference in its entirety.

FIELD

Reversible seat systems for boats, methods of using the reversible seat systems, and boats including the reversible seat systems are described herein.

BACKGROUND

A helm seat or leaning post is provided in many boats for an operator to use when driving the boat. In some instances, the helm seat may be configured for the operator to operate the controls from either a seated or standing position. Existing helm seats are typically optimized for use while operating the boat, not for use when the boat is at rest. In addition, many seats located on the deck between the helm and the stern of a boat are typically optimized for use in only one of a forward-facing or aft-facing seating position.

SUMMARY

Reversible seat systems for boats, methods of using the reversible seat systems, and boats including the reversible seat systems are described herein. The reversible seat systems described herein can be moved between a forward-facing configuration and aft-facing configuration by rotating a seat of the seat system about a seat axis generally aligned with the deck of a boat on which the reversible seat system is mounted.

The reversible seat systems described herein rotate about a horizontal axis for easy conversion between the forward-facing and aft-facing configurations.

The reversible seat systems described herein provide, in one or more embodiments, a seat apparatus that provides for a higher seating position when in, e.g., a forward-facing configuration and a lower seating position when in, e.g., an aft-facing configuration. When used as a helm seat (i.e., a seat positioned for use of an operator at the helm of a boat), the reversible seat systems described herein provide the operational benefits of a conventional helm seat including a higher seated position while also allowing the operator to stand/lean against the higher seat) with the benefits of a lower rear facing seat that is more conducive to socializing and relaxation-particularly when paired with forward-facing stern seating found on many boats. When used in positions other than at the helm of a boat (e.g., at a location between a helm seat and the stern of a boat), the higher seating position in the forward-facing configuration of the reversible seat systems described herein may provide those using the seat an improved view when, e.g., the boat is moving forward and the lower seating position in the aft-facing configuration may be more conducive to socializing and relaxation when, e.g., the boat is at rest.

The reversible seat systems described herein may also occupy very little (if any) additional space between the reversible seat system and the stern when converted from the forward-facing configuration to the aft-facing configuration. As a result, the amount of space available for socializing between passengers seated on the reversible seat system (in its aft-facing configuration) may be enhanced.

Although the reversible seat systems described herein are convertible between different configurations described as forward-facing and aft-facing (and with portions such as seating surfaces also being described in terms of forward and rear), it should be understood that the reversible seat systems described herein can be installed on a boat in any orientation with the positional language (forward, aft, rear, etc.) being used only to distinguish between the different configurations. For example, the reversible seat systems may be installed such that a person seated on the reversible seat system is facing "aft" when the reversible seating system is in the forward-facing configuration and facing "forward" when the reversible seating system is in the aft-facing configuration.

In a first aspect, one or more embodiments of a reversible seat system for a boat as described herein may include: a platform configured to be attached to a deck of a boat; and a seat supported above a deck of the boat by the platform, the seat configured to move between a forward-facing configuration and an aft-facing configuration, wherein the seat rotates about a seat axis when moving between the forward-facing configuration and the aft-facing configuration, wherein the seat comprises a forward seating surface and an aft seating surface, wherein the forward seating surface is aligned with the deck when the seat is in the forward-facing configuration and wherein the aft seating surface is aligned with the deck when the seat is in the aft-facing configuration.

In one or more embodiments of the reversible seat systems described herein, the aft seating surface is in an upright orientation when the seat is in the forward-facing configuration.

In one or more embodiments of the reversible seat systems described herein, the forward seating surface is in an upright orientation when the seat is in the aft-facing configuration.

In one or more embodiments of the reversible seat systems described herein, the orientation of the forward seating surface relative to the aft seating surface is fixed.

In one or more embodiments of the reversible seat systems described herein, the forward seating surface and the aft seating surface meet at a seating surface junction, wherein the forward seating area comprises a leading edge located distal from the seating surface junction, and the seat axis is located closer to the leading edge of the forward seating surface than the seating surface junction.

In one or more embodiments of the reversible seat systems described herein, when the seat is in the forward-facing configuration, a seating height of the forward seating surface above a deck on which the platform is mounted is greater than a seating height of aft seating surface when the seat is in the aft-facing configuration.

In one or more embodiments of the reversible seat systems described herein, when the seat is in the forward-facing configuration, the seat axis is located between the forward seating surface and the deck, and the aft seating surface is located below the seat axis when the seat is in the aft-facing configuration.

In one or more embodiments of the reversible seat systems described herein, a position of the seat axis relative to the platform is fixed.

In one or more embodiments of the reversible seat systems described herein, a position of the seat axis relative to the seat is fixed.

In one or more embodiments of the reversible seat systems described herein, a position of the seat axis relative to the platform and the seat is fixed.

In one or more embodiments of the reversible seat systems described herein, the seat axis is generally aligned with a deck on which the platform is mounted.

In one or more embodiments of the reversible seat systems described herein, the platform comprises a support structure configured to support the seat above a deck on which the platform is located when the seat is in the aft-facing configuration.

In one or more embodiments of the reversible seat systems described herein, the system comprises a latch apparatus movable between a secured configuration and an unsecured configuration, wherein the latch apparatus is configured to prevent rotation of the seat about the seat axis when in the secured configuration, and wherein the latch apparatus is configured to allow rotation of the seat about the seat axis when in the unsecured configuration.

In one or more embodiments of the reversible seat systems including a latch apparatus as described herein, the latch apparatus comprises an actuator and at least one pin, wherein the actuator is configured to move the pin between an extended position and a retracted position, wherein the pin is in the extended position and located in a pin aperture when the latch apparatus is in the secured configuration, and wherein the pin is in the retracted position when the latch apparatus is in the unsecured configuration. In one or more embodiments, the actuator of the latch apparatus is mounted on the seat such that the actuator rotates with the seat about the seat axis when the seat moves between the forward-facing configuration and the aft-facing configuration.

In a second aspect, one or more embodiments of a method of modifying a seat system of a boat as described herein includes: rotating a seat of the seat system between a forward-facing configuration and an aft-facing configuration, wherein the seat comprises a forward seating surface and an aft seating surface, wherein the forward seating surface is aligned with the deck when the seat is in the forward-facing configuration and wherein the aft seating surface is aligned with the deck when the seat is in the aft-facing configuration; wherein the rotating comprises rotating the seat about a seat axis aligned with a deck of a boat to which the seat system is attached; and securing the seat in the forward-facing configuration after rotating the seat to the forward-facing configuration from the aft-facing configuration.

In one or more embodiments of the methods of modifying a seat system of a boat as described herein, the aft seating surface is in an upright orientation when the seat is in the forward-facing configuration.

In one or more embodiments of the methods of modifying a seat system of a boat as described herein, the forward seating surface is in an upright orientation when the seat is in the aft-facing configuration.

In one or more embodiments of the methods of modifying a seat system of a boat as described herein, the orientation of the forward seating surface relative to the aft seating surface is fixed.

In one or more embodiments of the methods of modifying a seat system of a boat as described herein, the forward seating surface and the aft seating surface meet at a seating surface junction, wherein the forward seating area comprises a leading edge located distal from the seating surface junction, and wherein the seat axis is located closer to the leading edge of the forward seating surface than the seating surface junction.

In one or more embodiments of the methods of modifying a seat system of a boat as described herein, when the seat is in the forward-facing configuration, a seating height of the forward seating surface above a deck on which the platform is mounted is greater than a seating height of aft seating surface when the seat is in the aft-facing configuration.

In one or more embodiments of the methods of modifying a seat system of a boat as described herein, when the seat is in the forward-facing configuration, the seat axis is located between the forward seating surface and the deck, and the aft seating surface is located below the seat axis when the seat is in the aft-facing configuration.

In one or more embodiments of the methods of modifying a seat system of a boat as described herein, a position of the seat axis relative to the platform is fixed.

In one or more embodiments of the methods of modifying a seat system of a boat as described herein, a position of the seat axis relative to the seat is fixed.

In one or more embodiments of the methods of modifying a seat system of a boat as described herein, the platform comprises a support structure configured to support the seat above a deck on which the platform is located when the seat is in the aft-facing configuration.

In one or more embodiments of the methods of modifying a seat system of a boat as described herein, the system comprises a latch apparatus movable between a secured configuration and an unsecured configuration, wherein securing the seat in the forward-facing configuration comprises moving the latch apparatus to the secured configuration.

In a third aspect, one or more embodiments of a boat as described herein includes a reversible seat system as described herein with the platform of the reversible seat system mounted on a deck of the boat.

In one or more embodiments of a boat as described herein, a control console is located forward of the reversible seat system, wherein the aft seating surface faces the console when the seat is in the forward-facing configuration, and wherein the forward seating surface faces away from the control console when the seat is in the aft-facing configuration.

In one or more embodiments of a boat as described herein, the seat axis extends between the port and starboard sides of the boat.

In one or more embodiments of a boat as described herein, the reversible seat system comprises a helm seat.

If used herein, the term "substantially" has the same meaning as "significantly," and can be understood to modify the term that follows by at least about 75%, at least about 90%, at least about 95%, or at least about 98%. The term "not substantially" as used here has the same meaning as "not significantly," and can be understood to have the inverse meaning of "substantially," i.e., modifying the term that follows by not more than 25%, not more than 10%, not more than 5%, or not more than 2%.

Numeric values used herein include normal variations in measurements as expected by persons skilled in the art and should be understood to have the same meaning as "approximately" and to cover a typical margin of error, such as ±5% of the stated value.

Terms such as "a," "an," and "the" are not intended to refer to only a singular entity but include the general class of which a specific example may be used for illustration.

The terms "a," "an," and "the" are used interchangeably with the term "at least one." The phrases "at least one of"

and "comprises at least one of" followed by a list refers to any one of the items in the list and any combination of two or more items in the list.

As used here, the term "or" is generally employed in its usual sense including "and/or" unless the content clearly dictates otherwise. The term "and/or" means one or all of the listed elements or a combination of any two or more of the listed elements.

As used herein, positional terms such as "above," "below," "forward," "aft," "port," "starboard," "bow," "stern," etc. may generally (unless noted otherwise herein) refer to the position of a component, feature, etc. with respect to other components, features, etc. in a boat in an upright static floating position.

The words "preferred" and "preferably" refer to embodiments that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

Figure 1:
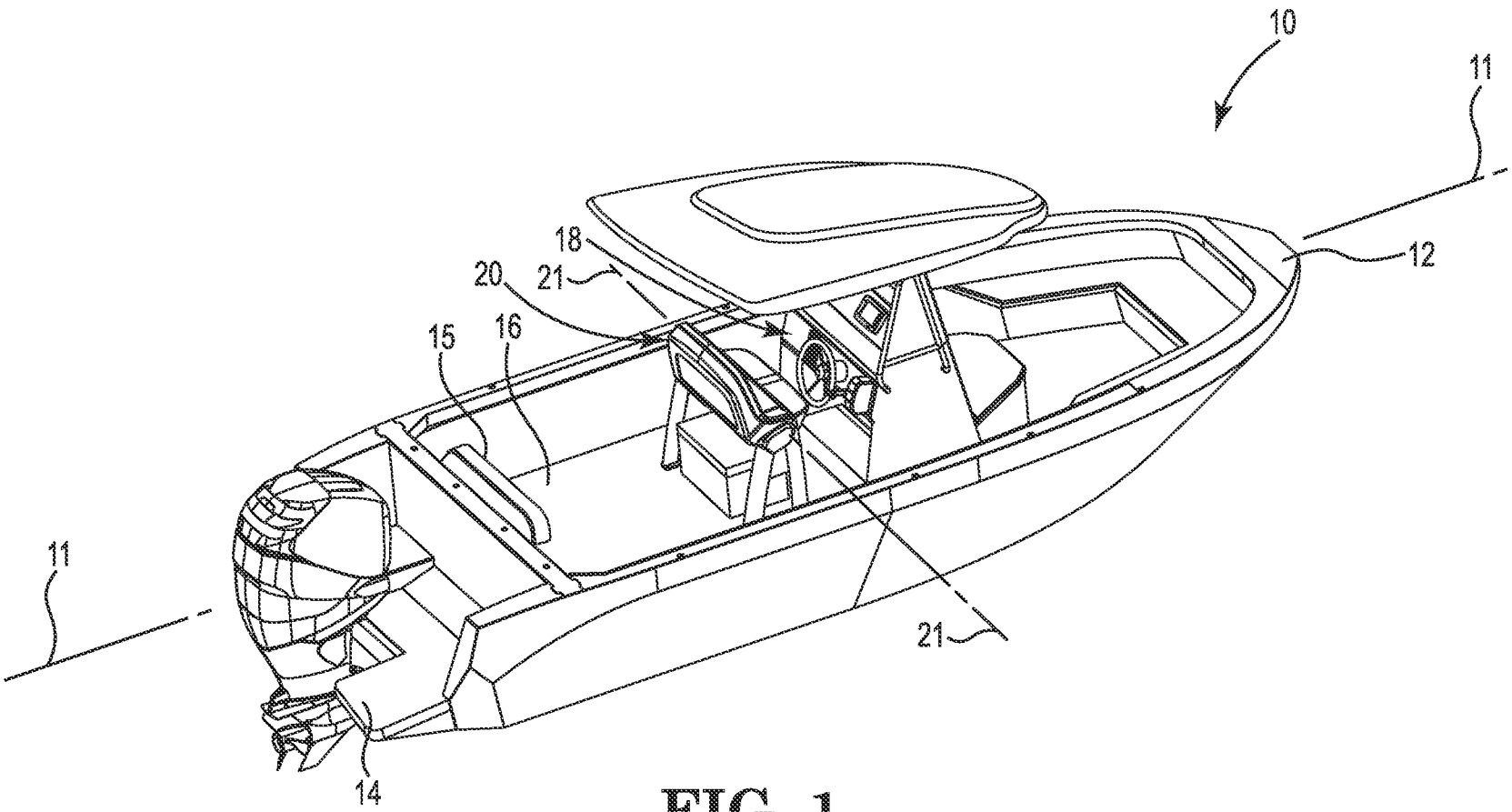
FIG. 1 is a perspective view of one illustrative embodiment of a boat including one illustrative embodiment of a reversible seat system as described herein.

While the above-identified figures (which may or may not be drawn to scale) depict illustrative embodiments of the invention, other embodiments are also contemplated as noted, e.g., in the discussion. In all cases, this disclosure presents the invention by way of representation and not limitation. It should be understood that numerous other modifications and embodiments can be devised by those skilled in the art, which fall within the scope of this invention.

DESCRIPTION OF ILLUSTRATIVE EMBODIMENTS

Before any illustrative embodiments are described in detail, it is to be understood that the invention is not limited in its application to the details of construction and the arrangement of components set forth in the following description or illustrated in the figures of the drawing. The invention is capable of other embodiments and of being practiced or of being carried out in various ways.

One illustrative example of a boat including a one illustrative embodiment of a reversible seat system as described herein is depicted in FIG. 1. The boat 10 extends from a bow 12 to a stern 14 along a bow-stern axis 11 as well as a deck 16. A cockpit area is located between the reversible seat system 20 and the console 18 and a seating area is located between the reversible seat system 20 and the stern 14. The console 18 includes controls used to operate the boat 10, with an operator either seated on the reversible seat system 20 or standing between the reversible seat system 20 and the console (where the operator optionally leaning against the reversible seat system 20.

The depicted embodiment of boat 10 includes stern seating 15 that, in the depicted view is in a stowed configuration, with seating surfaces being deployable such that passengers can be seated forward of the stern 14 above the deck 16, with the stern seating facing the reversible seat system 20 and the bow 12 of the boat 10 when deployed.

Although the illustrative embodiment of the reversible seat system 20 is positioned as a helm seat on the deck 16 of the boat 10, the reversible seat systems described herein could be used in other locations on a boat. For example, on a larger boat with more space between the helm and the stern, one or more reversible seat systems 20 could be provided between a helm seat (either a reversible helm seat system 20 as seen in FIG. 1 or a conventional helm seat) and the stern of the boat. In another variation, the reversible seat systems described herein could be provided in place of conventional stern seating to allowed for a forward-facing configuration during, e.g., operation of the boat and an aft-facing configuration for use in, e.g., fishing, socializing or relaxing when at the boat is at rest (with, e.g., people located on a swim platform at the stern of the boat, people in other boats, etc.). When provided as an alternative to conventional stern seating, the reversible seat systems described herein may have a higher seating position when aft-facing and a lower seating position when forward-facing.

In still other alternatives, although the reversible seat system 20 is oriented with seat axis 21 perpendicular to the bow-stern axis 11, the orientation of the reversible seat systems described herein could also be variable. While it may be preferred (or even possibly required) that the reversible seat systems described herein be oriented perpendicular to the bow-stern axis 11 when used as a reversible helm seat, the reversible seat systems described herein could be positioned with any selected orientation when located elsewhere on the deck of a boat. For example, one or more of the reversible seat systems described herein could, in one or more embodiments, be oriented with their seat axis aligned with the bow-stern axis.

Figure 2:
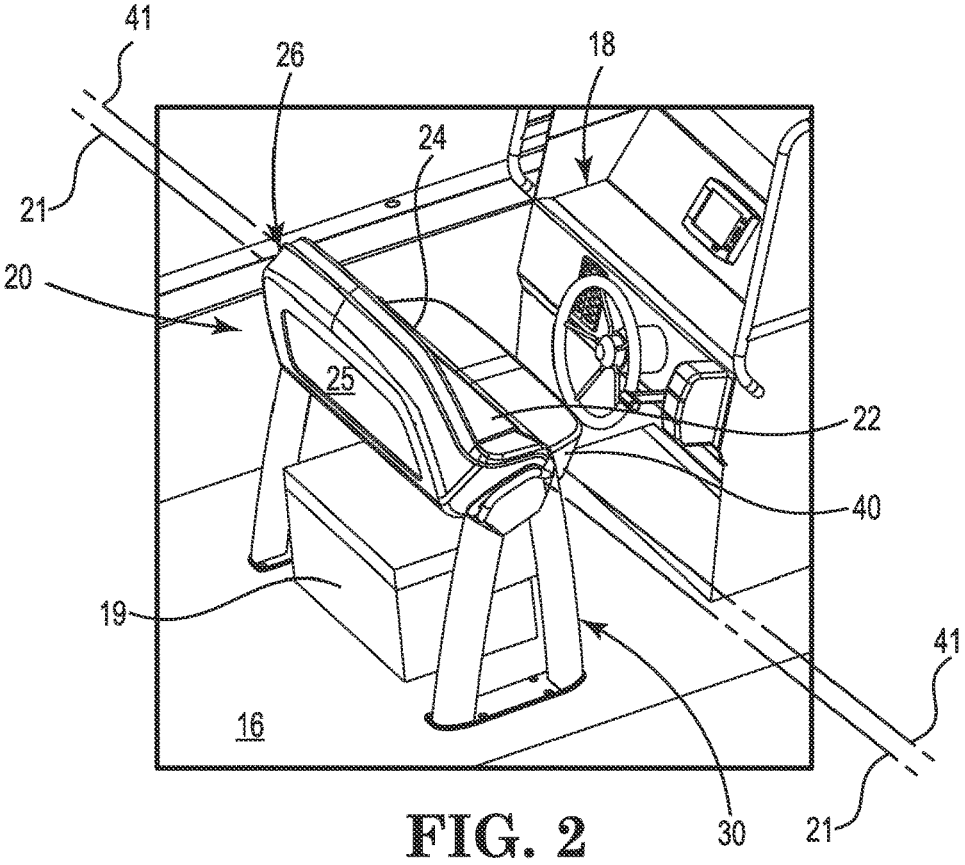
FIG. 2 is an enlarged port-side perspective view of another illustrative embodiment of the reversible seat system described herein with the reversible seat system in a forward-facing configuration.
Figure 3:
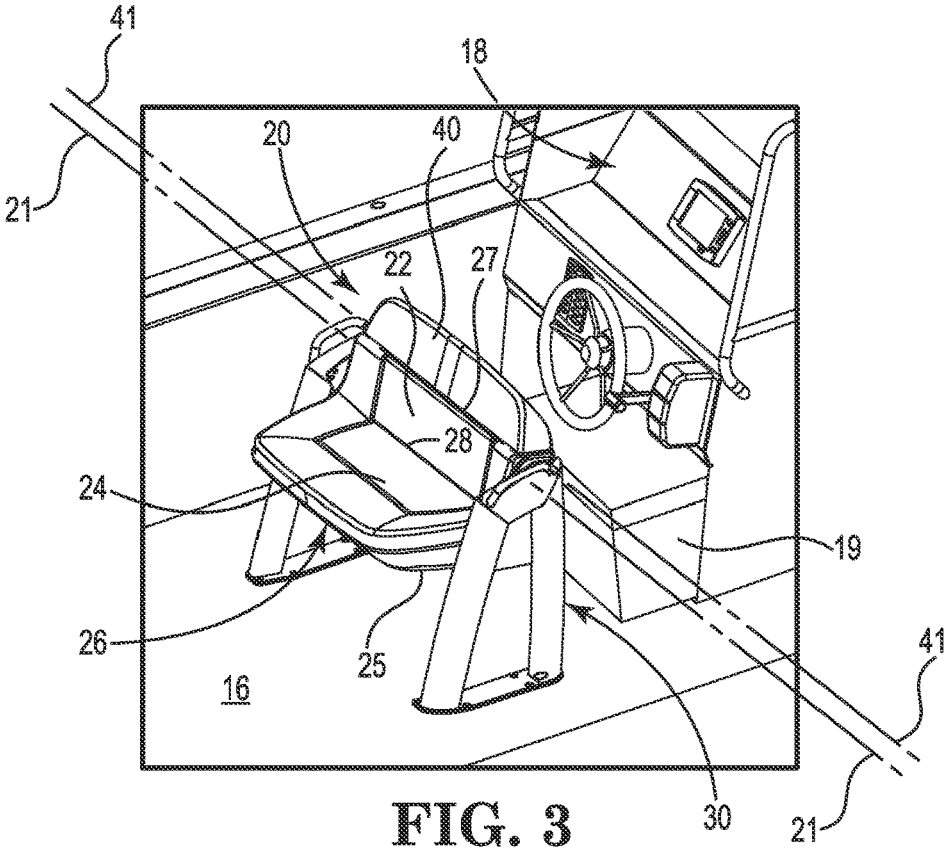
FIG. 3 is a starboard side perspective view of the reversible seat system of FIG. 2 in an aft-facing configuration.

The illustrative embodiment of a reversible seat system 20 is depicted in FIGS. 2-3. The reversible seat system 20 includes, in the depicted embodiment, a platform 30 configured for attachment to the deck 16 of the boat 10. The reversible seat system 20 also includes a seat 26 supported above the deck 16 of the boat 10 by the platform 30, the seat 26 configured to move between a forward-facing configuration as seen in FIG. 2 and an aft-facing configuration as seen in FIG. 3.

In the depicted illustrative embodiment of reversible seat system 20, the seat 26 has a width conducive to the seating of two people at a time in both the forward-facing and aft-facing configurations. In alternative embodiments of the reversible seat systems described herein, the seat may be designed to comfortably seat as few as one person or three or more persons in both the forward-facing and aft-facing configurations. In one or more embodiments of the reversible seat systems described herein, the width of the seat is unchanged when moved between the forward-facing configuration and aft-facing configurations.

To move between the forward-facing configuration and the aft-facing configuration, the seat 26 of the reversible seat system 20 rotates about a seat axis 21. In one or more embodiments of the reversible seat systems described herein, the position of the seat axis 21 relative to one or both of the platform 30 and the seat 26 is fixed. In one or more embodiments of the reversible seat systems described herein, the seat axis 21 may be generally aligned with the deck 16 on which the platform 30 is mounted. The phrase "generally aligned with" as used in connection with the seat axis 21 relative to the deck 16 in the reversible seat systems described herein may be described as meaning that the seat axis 21 is generally parallel to the deck 16. In one or more embodiments, the seat axis 21 may be perfectly parallel to the deck, but such an orientation is not required.

The seat 26 includes a forward seating surface 22 and an aft seating surface 24. The forward seating surface 22 is aligned with the deck 16 when the seat 26 is in the forward-facing configuration as seen in FIG. 2 and the aft seating surface 24 is aligned with the deck 16 when the seat 26 is in the aft-facing configuration as seen in FIG. 3. The phrase "aligned with" when used in connection with the forward seating surface 22 and the aft seating surface 24 means that the seating surface is generally parallel to the deck 16 but need not be perfectly parallel to the deck 16 because, as is well known, seating surfaces may be inclined relative to a surface such as a deck for the comfort of those seated.

In one or more embodiments of the reversible seat systems described herein, the aft seating surface 24 is in an upright orientation when the seat 26 is in the forward-facing configuration as seen in FIG. 2. The phrase "upright orientation" as used in connection with the aft seating surface 24 when the reversible seat system 20 is in the forward-facing configuration means that the aft seating surface 24 is generally perpendicular to the deck 16 of the boat 10 to provide support to the back of a person seated on the forward seating surface 22 when the reversible seat system 20 is in the forward-facing configuration. Although the aft seating surface 24 may be perfectly perpendicular to the deck 16 of the boat 10 in these conditions, that is not required and, in fact, it may be preferred that the aft seating surface 24 be slightly canted or angled backward for comfort of a person seated on the forward seating surface 22.

In one or more embodiments of the reversible seat systems described herein, the forward seating surface 22 is in an upright orientation when the seat 26 is in the aft-facing configuration as seen in FIG. 3. The phrase "upright orientation" as used in connection with the forward seating surface 22 when the reversible seat system 20 is in the aft-facing configuration means that the forward seating surface 22 is generally perpendicular to the deck 16 of the boat 10 to provide support to the back of a person seated on the aft seating surface 24 when the reversible seat system 20 is in the aft-facing configuration. Although the forward seating surface 22 may be perfectly perpendicular to the deck 16 of the boat 10 in these conditions, that is not required and, in fact, it may be preferred that the forward seating surface 22 be slightly canted or angled backward for comfort of a person seated on the aft seating surface 24.

In one or more embodiments of the reversible seat systems described herein, the orientation of the forward seating surface 22 relative to the aft seating surface 24 is fixed.

In one or more alternative embodiments, the orientation of the forward seating surface 22 relative to the aft seating surface 24 may be adjustable to allow for some variation in the orientation the upright seating surface relative to the other seating surface when the reversible seat system 20 is in one or both of the forward-facing or aft-facing configurations. Such adjustments may be useful to improve comfort of a person seated on the reversible seat system 20 (in a manner similar to, e.g., a car or truck seat). Even in those embodiments of the reversible seat systems described herein in which the orientation of the forward seating surface 22 relative to the aft seating surface 24 is not fixed, the forward seating surface 22 and the aft seating surface 24 can be placed in the orientations relative to each other as seen in the illustrative embodiment depicted in FIGS. 2 and 3 when the reversible seat systems are in the forward-facing and aft-facing configurations.

As noted above, movement between the forward-facing configuration and the aft-facing configuration involves rotating the seat 26 of the reversible seat system 20 about a seat axis 21. In one or more embodiments of the reversible seat systems described herein, the forward seating surface 22 and the aft seating surface 24 meet at a seating surface junction 28. In the depicted embodiment, the forward seating area 22 also includes a leading edge 27 located distal from the seating surface junction 28. In one or more embodiments, the seat axis 21 may be located closer to the leading edge 27 of the forward seating surface 22 than the seating surface junction 28.

As seen in FIGS. 2 and 3, when the seat 26 of the reversible seat system 20 is in the forward-facing configuration of FIG. 2, the seat axis 21 can be described as being located between the forward seating surface 22 and the deck 16, and the aft seating surface 24 can be described as being located below the seat axis 24 when the seat 26 is in the aft-facing configuration of FIG. 3.

Locating the seat axis 21 closer to the leading edge 27 of the forward seating surface 22 than the seating surface junction 28 can be described as providing a number of advantages associated with the reversible seat systems described herein. For example, locating the seat axis 21 closer to the leading edge 27 of the forward seating surface 22 than the seating surface junction 28 results in raising the height of the forward seating surface 22 above the deck 16 (when the reversible seat system 20 is in the forward-facing configuration of FIG. 2) as compared to the height of the aft seating surface 24 above the deck 16 (when the reversible seat system 20 is in the aft-facing configuration of FIG. 3). As a result, when the seat is in the forward-facing configuration, a seating height of the forward seating surface 22 above the deck 16 on which the platform 30 is mounted is greater than a seating height of the aft seating surface 24 when the seat 26 is in the aft-facing configuration. As discussed herein, a higher seating surface 22 in the forward-facing configuration and a lower seating surface 24 in the aft-facing configuration may provide improved comfort and/or usability in both configurations.

In one or more embodiments, the difference in the height of the seating surfaces in the different configurations of the reversible seat systems described herein can be changed by changing the location of the seat axis 21 between the leading edge 27 of the forward seating surface 22 and the seating surface junction 28. The difference in the height of the seating surfaces increases as the seat axis 21 is located closer to the leading edge 27 of the forward seating surface 22 and decreases as the seat axis 21 is located closer to the seating surface junction 28. In one or more embodiments, the range of seat height variation between the configurations can be 10 inches or higher, although reversible seat systems as described herein can also be designed with essentially no difference in seating height between the two configurations.

In one or more embodiments of the reversible seat systems described herein, the seat may include an optional bolster when, e.g., positioned for use as a helm seat, to increase the surface area against which an operator can rest when the reversible seat system is in the forward-facing configuration and the operator is standing at the control console of the boat. Rotating the bolster can also provide an even higher seating surface (relative to the deck) and increase the space between the reversible seat system and the control console. When not rotated upward for a standing operator, the bolster can provide additional seating depth when the reversible seat system is in the forward-facing configuration. In the depicted illustrative embodiment, the bolster 40 is located along the leading edge 27 of the forward seating surface 22 and can be rotated upward about bolster axis 41 (in FIG. 2) such that the bolster 40 would be located above the forward seating surface 22.

Figure 4:
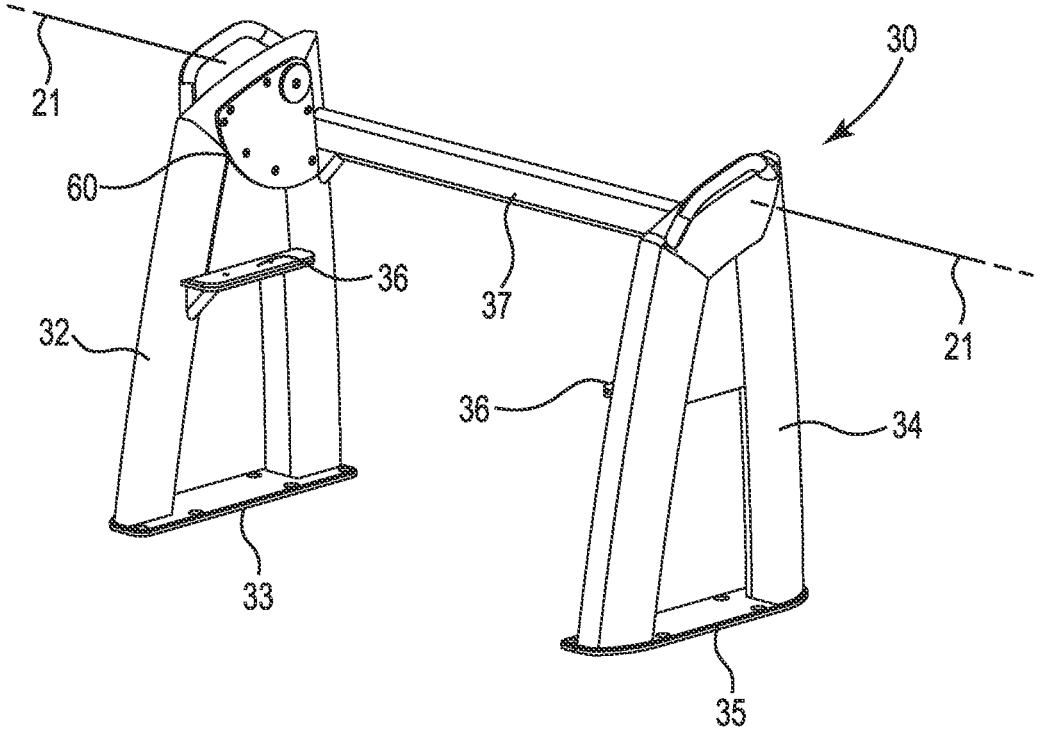
FIG. 4 is a downward facing starboard-side perspective view of the platform used in the reversible seat system of FIGS. 2-3 with the seat removed from the platform.
Figure 5:
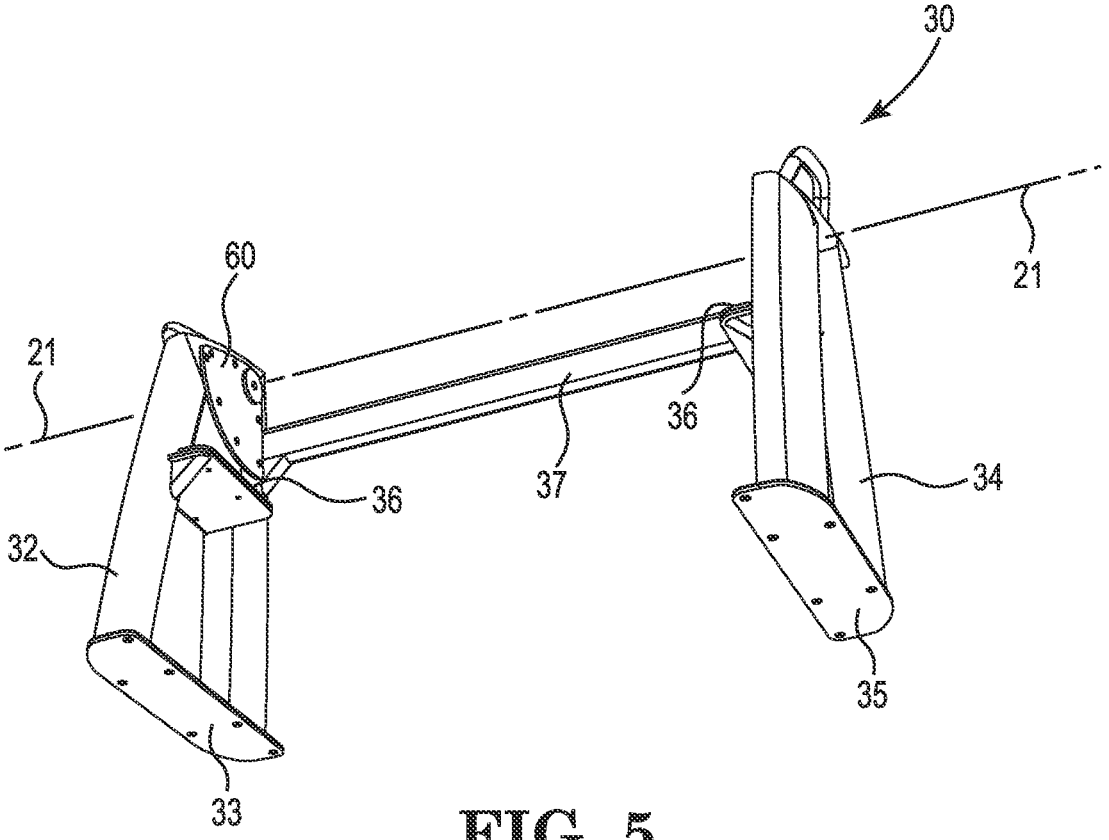
FIG. 5 is an upward facing starboard-side perspective view of the platform of FIG. 4.

The platforms of one or more embodiments of reversible seat systems as described herein may include one or more of a variety of features as depicted in connection with the illustrative embodiment of platform 30. With reference to FIGS. 4-5, the depicted platform includes a pair of stanchions 32 and 34, with a port side stanchion 32 located on the port side of the reversible seat system 20 and a starboard side stanchion 34 located on the starboard side of the reversible seat system 20. The port side stanchion 32 includes a base 33 configured for attachment to a deck and the starboard side stanchion 34 incudes a base configured for attachment to a deck.

In the depicted embodiment of platform 30, the port side stanchion 32 and the starboard side stanchion 34 are connected to each other by an optional crossbar 37 to improve rigidity of the platform 30 when supporting a seat 26 of a reversible seat system as described herein. In addition, although the depicted illustrative embodiment of the platform 30 may be conveniently constructed as a welded metal (e.g., aluminum, stainless steel, etc.) structure, the platforms used in the reversible seat systems described herein can be manufactured using any suitable material(s) and/or construction technique(s).

In one or more embodiments, the platforms of the reversible seat systems described herein may also be constructed with integrated storage and/or space for one or more removable storage containers located below the seat. With reference to FIGS. 2 and 3, the depicted illustrative embodiment of reversible seat system 20 provides space for a container 19 when the reversible seat system 20 is in the forward-facing configuration as depicted in FIG. 2. The container 19 is depicted after relocation to a more forward position in FIG. 3 when the reversible seat system 20 is in the aft-facing configuration. A smaller container and/or integrated storage compartment could be used that would allow for conversion of the reversible seat system 20 without requiring relocation of any storage.

Figure 6:
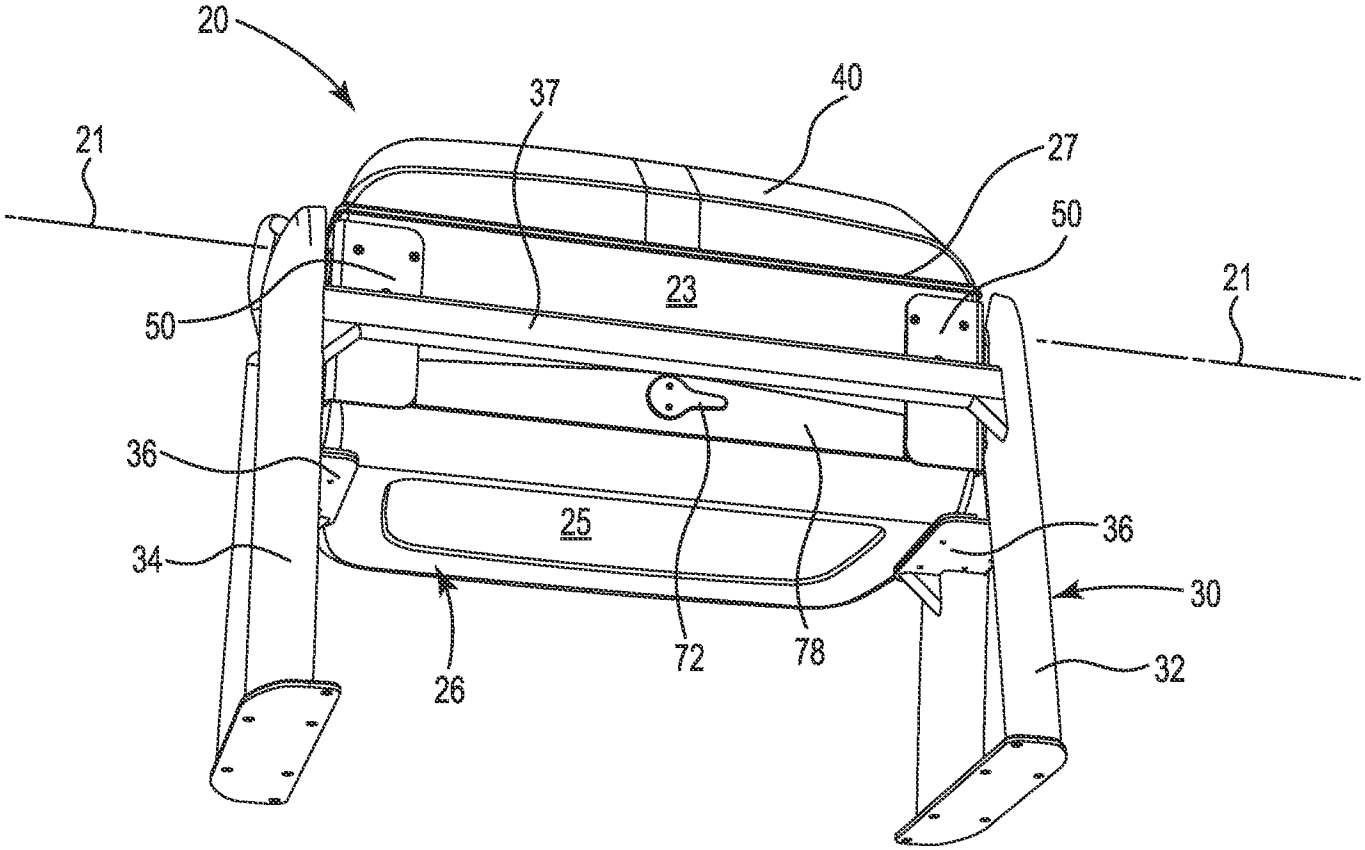
FIG. 6 is an upward facing forward-side view of the reversible seat system of FIG. 3 (in which the reversible seat system is in the aft-facing configuration).

In one or more embodiments of the reversible seat systems described herein, the platform includes support structure configured to support the seat above a deck on which the platform is located when the seat is in the aft-facing configuration. In the illustrative embodiment of the reversible seat system 20, the platform 30 includes support structure in the form of a pair of stops 36 to at least partially support the seat 26 when the reversible seat system 20 is in the aft-facing configuration as seen in FIG. 3. With reference to FIG. 6, the outer surface 25 of the seat 26 located opposite the aft seating surface 24 rests on stops 36 of platform 30 when the reversible seat system 20 is in the aft-facing configuration to assist in supporting the eat 26 in that orientation.

In one or more alternative embodiments, the stops 36 could be replaced and/or supplement by a second crossbar or other structure extending between the stanchions 32 and 34 to support the seat 26 in the aft-facing configuration of the reversible seat system 20.

Figure 7:
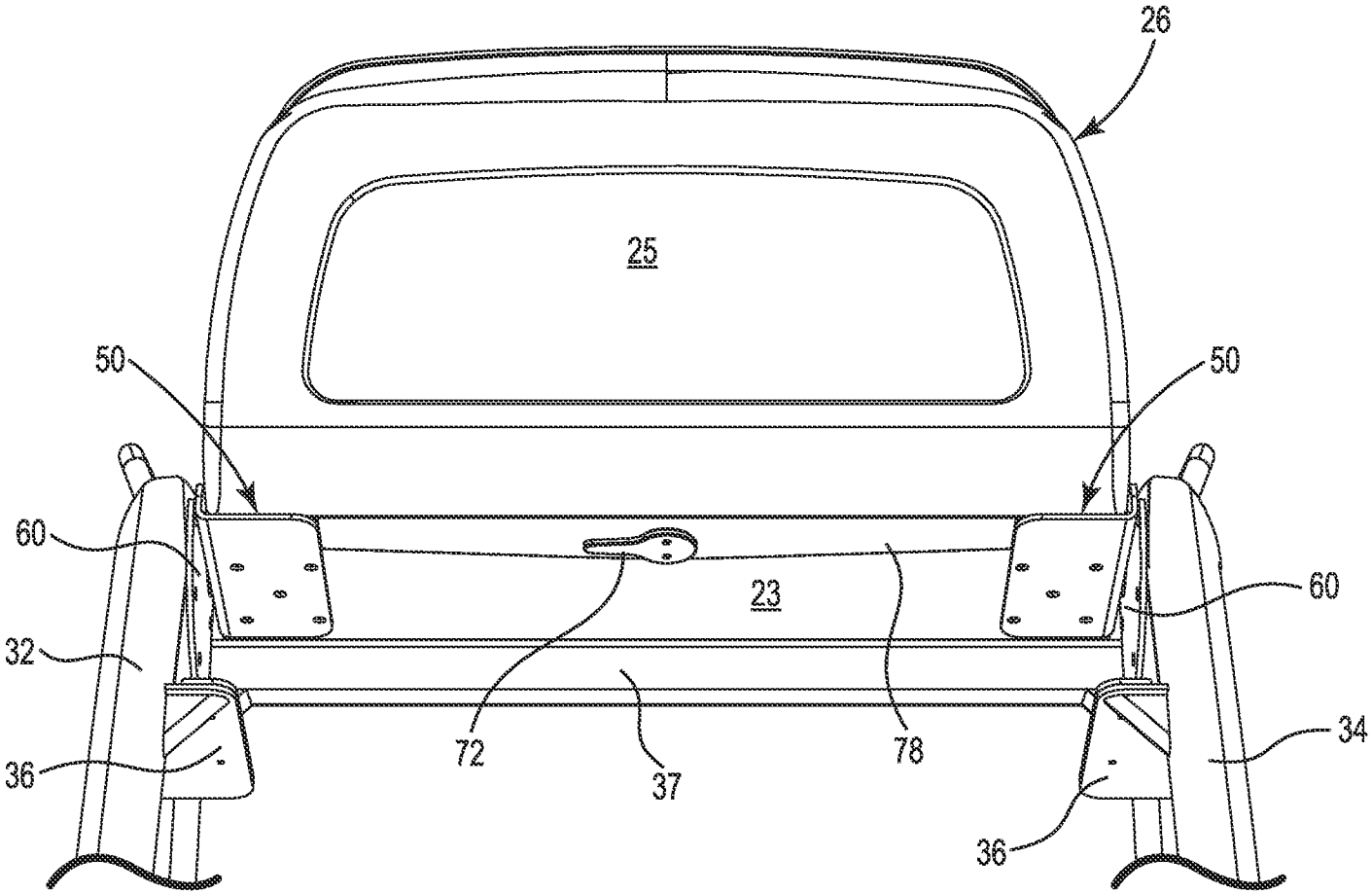
FIG. 7 is an upward facing aft-side view of the reversible seat system of FIG. 2 (in which the reversible seat system is in the forward-facing configuration).

Also depicted in connection with FIGS. 6 and 7 are the seat brackets 50 used to attach the seat 26 to the platform 30 in the depicted illustrative embodiment of the reversible seat system 20. In the depicted embodiment, the seat brackets 50 are attached to the outer surface 23 of the seat located opposite the forward seating surface 22. The seat brackets 50 support the seat 26 as it rotates about seat axis 21.

Figure 8:
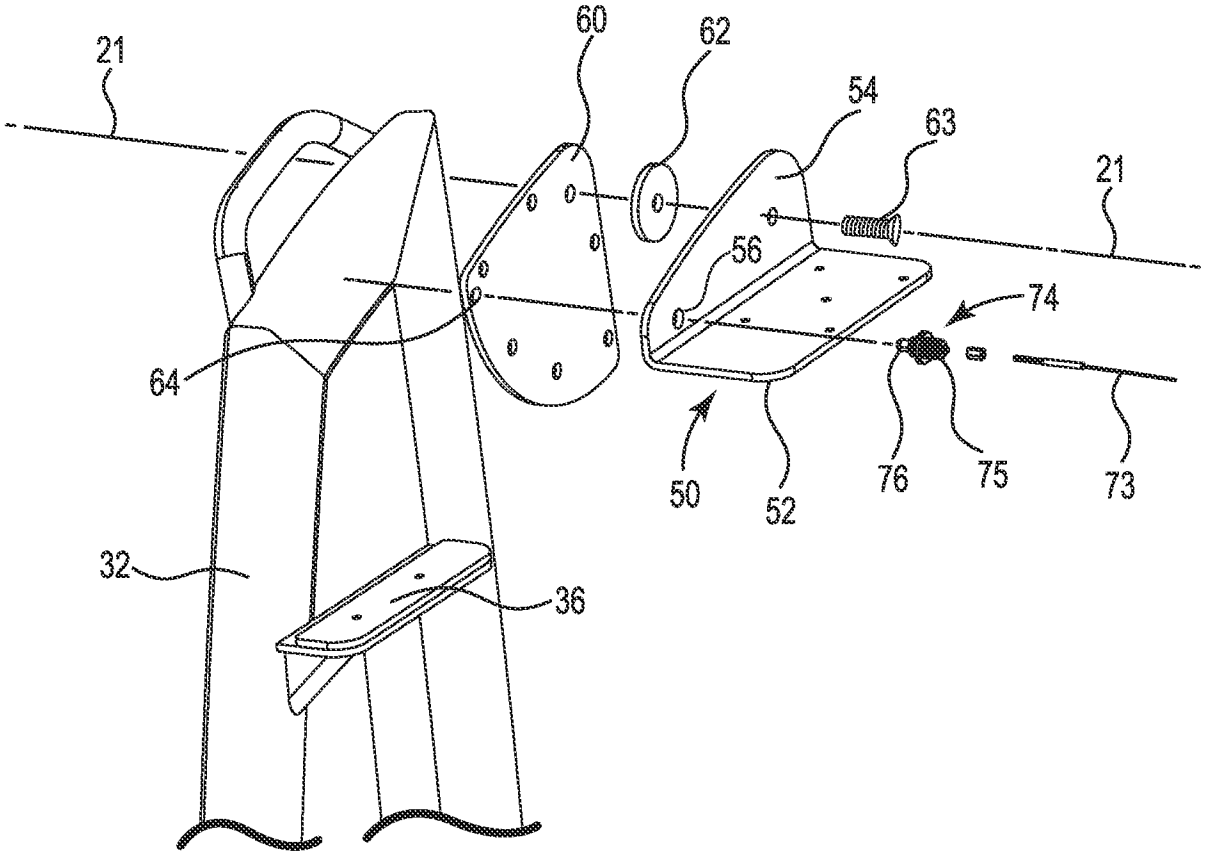
FIG. 8 is an exploded view of the interface between a seat bracket, the latch apparatus, and a mounting plate on the port side of another illustrative embodiment of a platform of a reversible seat system as described herein.

With reference to FIG. 8, the assembly used to connect one of the seat brackets 50 and the port side stanchion 32 is depicted in an exploded diagram (it being understood that the depicted connection is only one embodiment of many different assemblies that could be used to rotatably attach the seat to a stanchion in a reversible seat system as described herein).

As seen in FIG. 8, the assembly includes a mounting plate 60 attached to the stanchion 32 using any suitable technique or combination of techniques (e.g., mechanical fasteners, adhesives, welding, etc.). Side portion 54 of the seat bracket 50 is attached to the mounting plate 60 using fastener 63, with bushing 62 being located between the seat bracket 50 and the mounting plate 60. The fastener 63 is located along the seat axis 21 and the bushing 62/fastener 63 allow the seat bracket to rotate about the seat axis 21. Because the seat 26 is attached to the seat bracket 50 (more specifically, to the bottom portion 52 of the seat bracket 50 as seen in FIG. 8), rotation of the seat bracket 50 about seat axis 21 results in rotation of the seat 26 about the seat axis 21 as described herein.

Figure 9:
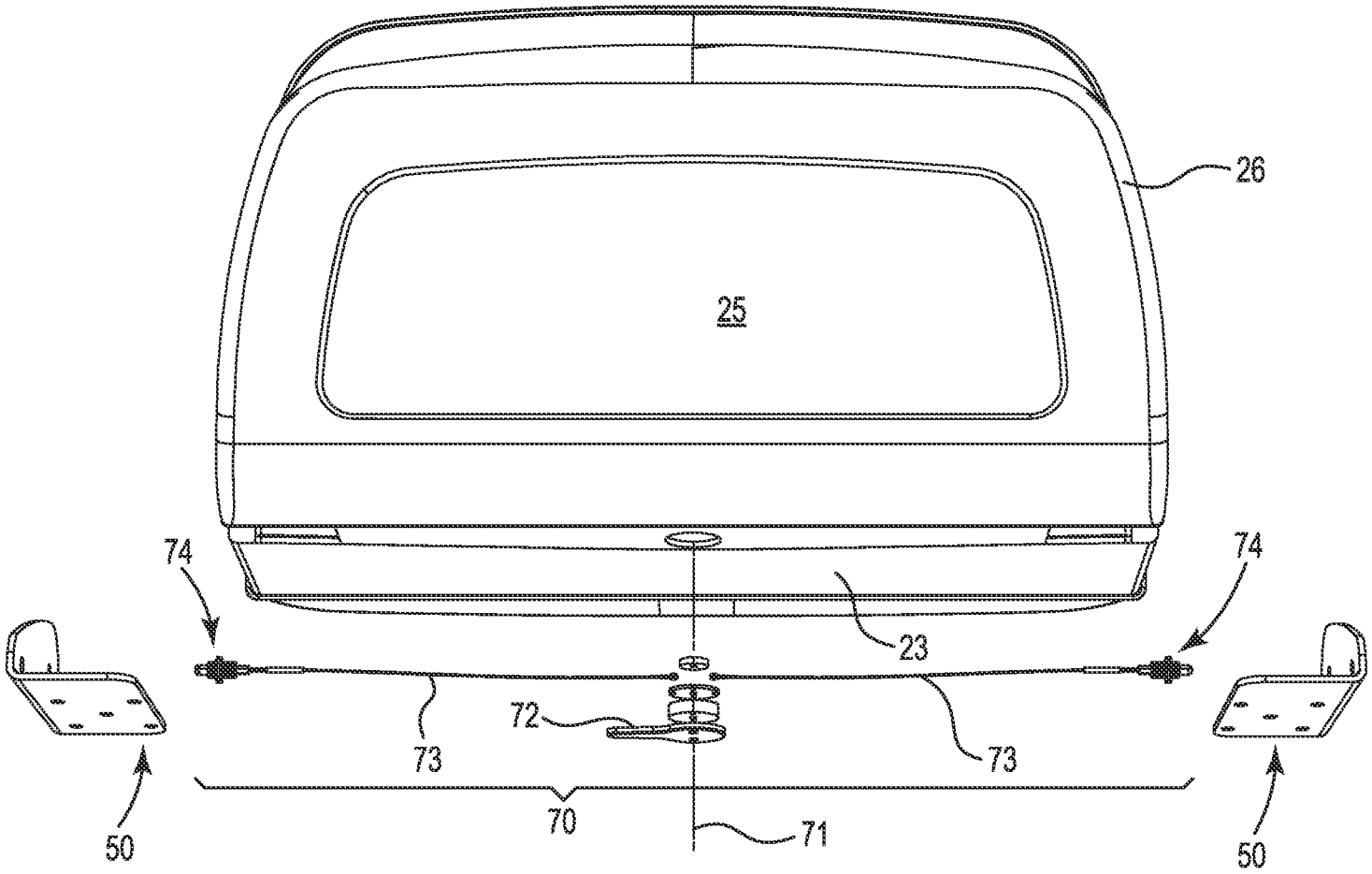
FIG. 9 depicts the seat of the reversible seat system of FIG. 2 removed from the system, with components of one illustrative embodiment of a latch apparatus depicted in an exploded view along with seat brackets used to mount the seat to the platform.

One or more embodiments of the reversible seat systems described herein also include a latch apparatus configured to prevent rotation of the seat about the seat axis when the latch apparatus is in a secured configuration, the latch apparatus further being configured to allow rotation of the seat about the seat axis when in an unsecured configuration. With reference to the depicted illustrative embodiment of the reversible seat system 20, one illustrative embodiment of a latch apparatus 70 is depicted in an exploded assembly diagram in FIG. 9 (with many of the components of the latch apparatus 70 normally being obscured by a latch apparatus cover 78 as seen in, e.g., FIGS. 6 & 7).

The latch apparatus 70 includes an actuator 72 and a one or more pins 76, with the actuator 72 being configured to move the pins 76 between an extended position and a retracted position. The pins 76 are in the extended position and located in pin apertures 64 in the mounting plates 60 when the latch apparatus 70 is in the secured configuration. The pins 76 are in the retracted position when the latch apparatus 70 is in the unsecured configuration.

One optional feature depicted in, e.g., FIG. 8 is the offset between the seat axis 21 and the pin apertures 64. In one or more embodiments, the offset between the seat axis 21 and the pin apertures 64 can be helpful in provided additional stability and/or weight capacity to the seat 26 when the seat 26 is in the forward-facing configuration. In one or more embodiments, the offset between the seat axis 21 and the pin apertures 64 can be increased to increase stability and/or weight capacity. In another variation, the size (e.g., diameter) of the pins 76 and the corresponding pin apertures 64 can be increased to increase the weight capacity of the reversible seat systems using larger pins 76 and pin apertures 64.

In the depicted illustrative embodiment, each of the pins 76 is located in a pin assembly 74 including a housing 75, with the pin 76 being retracted into the housing 75 when the pin 76 is in the retracted position. The housing 74 may include, for example, a spring or other biasing element configured to force the pin 76 into the extended position in the absence of a force countering the spring/biasing element. The housing 75 of each of the spring assemblies 74 may be attached to the seat 26 and/or the seat bracket 50 on each side of the seat 26.

In the depicted illustrative embodiment of the latch apparatus 70 of the reversible seat system 20, the actuator 72 is mounted on the seat 26 such that the actuator 72 rotates about the seat axis 21 when the seat 26 moves between the forward-facing configuration and the aft-facing configuration of the reversible seat system 20. The depicted actuator 72 rotates about an actuator axis 71 to move the pins 76 between their extended and retracted positions through cables 73. As the actuator 72 is rotated about actuator axis 71, the cables 73 are shortened or pulled towards the actuator 72 to pull the pins 76 to their retracted positions in housing 75. Although cables 73 are used in the depicted latch apparatus 70, any structure or article capable of moving the pins 76 into their retracted positions could be substituted for cables, e.g., wires, cords, rods, etc.

In the depicted illustrative embodiment, pins 76 are not located in apertures in the mounting plates 60 when the seat 26 is in the aft-facing configuration as seen in FIG. 6. This is acceptable because the seat 26 is supported by the stops 36 on the platform 30 and, by virtue of its weight and the location of the seat axis 21, will stay in that position unless actively rotated about seat axis 21 to the forward-facing configuration seen in FIGS. 2 and 7. In one or more alternative embodiments, however, pin apertures could be provided in the mounting plate 60 to receive pins 76 when the seat 26 is in the aft-facing configuration if so desired.

Although the depicted illustrative embodiment of the latch apparatus 70 includes a central actuator 72 that acts on pins 76 located on opposite sides of the seat 26, one or more alternative embodiments of latch apparatus that may be used with the reversible seat system described herein may include separate actuators for each pin.

Furthermore, one or more other embodiments of latch apparatus that may be used in the reversible seat systems described herein may use any suitable mechanism and/or technique to move the pins between their extended and their retracted positions. For example, the pins of latch apparatus described herein could be moved using one or more of pneumatic, hydraulic, electric, magnetic, etc. actuators.

Although the depicted illustrative embodiment of the reversible seat systems described herein include pins mounted on the movable seat and complementary apertures in/on the fixed or stationary platform/mounting plate, one or more alternative embodiments of the reversible seat systems described herein may include a latch apparatus in which the locations of the components are reversed, i.e., the pins may be provided on the fixed or stationary platform/mounting plate and the complementary apertures may be provided on the movable seat.

All references and publications cited herein are expressly incorporated herein by reference in their entirety into this disclosure, except to the extent they may directly contradict this disclosure. Although specific illustrative embodiments have been described herein, it will be appreciated by those of ordinary skill in the art that a variety of alternate and/or equivalent implementations can be substituted for the specific embodiments shown and described without departing from the scope of the present disclosure. It should be understood that this disclosure is not intended to be unduly limited by the illustrative embodiments and examples set forth herein and that such examples and embodiments are presented by way of example only with the scope of the disclosure intended to be limited only by the claims.

What is claimed is:

1. A reversible seat system for a boat, the reversible seat system comprising:

a platform configured to be attached to a deck of a boat; and a seat supported above a deck of the boat by the platform, the seat configured to move between a forward-facing configuration and an aft-facing configuration, wherein the seat rotates about a seat axis when moving between the forward-facing configuration and the aft-facing configuration, wherein the seat comprises a forward seating surface and an aft seating surface, wherein the forward seating surface is aligned with the deck when the seat is in the forward-facing configuration and wherein the aft seating surface is aligned with the deck when the seat is in the aft-facing configuration;

wherein, when the seat is in the forward-facing configuration, a seating height of the forward seating surface above a deck on which the platform is mounted is greater than a seating height of aft seating surface when the seat is in the aft-facing configuration.

2. A system according to claim 1, wherein the forward seating surface and the aft seating surface meet at a seating surface junction, wherein the forward seating area comprises a leading edge located distal from the seating surface junction, and wherein the seat axis is located closer to the leading edge of the forward seating surface than the seating surface junction.

3. A system according to claim 1, wherein, when the seat is in the forward-facing configuration, the seat axis is located between the forward seating surface and the deck, and wherein the aft seating surface is located below the seat axis when the seat is in the aft-facing configuration.

4. A system according to claim 1, wherein a position of the seat axis relative to the platform is fixed.

5. A system according to claim 1, wherein a position of the seat axis relative to the platform and the seat is fixed.

6. A system according to claim 1, wherein the system comprises a latch apparatus movable between a secured configuration and an unsecured configuration, wherein the latch apparatus is configured to prevent rotation of the seat about the seat axis when in the secured configuration, and wherein the latch apparatus is configured to allow rotation of the seat about the seat axis when in the unsecured configuration.

7. A method of modifying a seat system of a boat, the method comprising:

rotating a seat of the seat system between a forward-facing configuration and an aft-facing configuration, wherein the seat comprises a forward seating surface and an aft seating surface, wherein the forward seating surface is aligned with the deck when the seat is in the forward-facing configuration and wherein the aft seating surface is aligned with the deck when the seat is in the aft-facing configuration;

wherein the rotating comprises rotating the seat about a seat axis aligned with a deck of a boat to which the seat system is attached;

wherein, when the seat is in the forward-facing configuration, a seating height of the forward seating surface above a deck on which the platform is mounted is greater than a seating height of aft seating surface when the seat is in the aft-facing configuration; and securing the seat in the forward-facing configuration after rotating the seat to the forward-facing configuration from the aft-facing configuration.

8. A method according to claim 7, wherein the aft seating surface is in an upright orientation when the seat is in the forward-facing configuration.

9. A method according to claim 7, wherein the forward seating surface is in an upright orientation when the seat is in the aft-facing configuration.

10. A method according to claim 7, wherein an orientation of the forward seating surface relative to the aft seating surface is fixed.

11. A method according to claim 7, wherein the forward seating surface and the aft seating surface meet at a seating surface junction, wherein the forward seating area comprises a leading edge located distal from the seating surface junction, and wherein the seat axis is located closer to the leading edge of the forward seating surface than the seating surface junction.

12. A method according to claim 7, wherein, when the seat is in the forward-facing configuration, the seat axis is located between the forward seating surface and the deck, and wherein the aft seating surface is located below the seat axis when the seat is in the aft-facing configuration.

13. A method according to claim 7, wherein a position of the seat axis relative to the platform is fixed.

14. A method according to claim 7, wherein a position of the seat axis relative to the seat is fixed.

15. A method according to claim 7, wherein the platform comprises a support structure configured to support the seat above a deck on which the platform is located when the seat is in the aft-facing configuration.

16. A method according to claim 7, wherein the system comprises a latch apparatus movable between a secured configuration and an unsecured configuration, wherein securing the seat in the forward-facing configuration comprises moving the latch apparatus to the secured configuration.

17. A boat comprising:

a reversible seat system according to claim 1, wherein the platform of the reversible seat system is mounted on a deck of the boat.

18. A boat according to claim 17, wherein a control console is located forward of the reversible seat system, wherein the aft seating surface faces the console when the seat is in the forward-facing configuration, and wherein the forward seating surface faces away from the control console when the seat is in the aft-facing configuration.

19. A boat according to claim 17, wherein the seat axis extends between the port and starboard sides of the boat.

20. A boat according to claim 17, wherein the reversible seat system comprises a helm seat.

21. A system according to claim 1, wherein the forward seating surface and the aft seating surface meet at a seating surface junction, wherein the forward seating area comprises a leading edge located distal from the seating surface junction, and wherein the seat axis is located closer to the leading edge of the forward seating surface than the seating surface junction;

wherein, when the seat is in the forward-facing configuration, the seat axis is located between the forward seating surface and the deck, and wherein the aft seating surface is located below the seat axis when the seat is in the aft-facing configuration;

and wherein a position of the seat axis relative to the platform is fixed.

22. A reversible seat system for a boat, the reversible seat system comprising:

a platform configured to be attached to a deck of a boat; and a seat supported above a deck of the boat by the platform, the seat configured to move between a forward-facing configuration and an aft-facing configuration, wherein the seat rotates about a seat axis when moving between the forward-facing configuration and the aft-facing configuration, wherein the seat comprises a forward seating surface and an aft seating surface, wherein the forward seating surface is aligned with the deck when the seat is in the forward-facing configuration and wherein the aft seating surface is aligned with the deck when the seat is in the aft-facing configuration;

and wherein, when the seat is in the forward-facing configuration, the seat axis is located between the forward seating surface and the deck, and wherein the aft seating surface is located below the seat axis when the seat is in the aft-facing configuration.

23. A system according to claim 22, wherein a position of the seat axis relative to the platform is fixed.

24. A reversible seat system for a boat, the reversible seat system comprising:

a platform configured to be attached to a deck of a boat; and a seat supported above a deck of the boat by the platform, the seat configured to move between a forward-facing configuration and an aft-facing configuration, wherein the seat rotates about a seat axis when moving between the forward-facing configuration and the aft-facing configuration, wherein the seat comprises a forward seating surface and an aft seating surface, wherein the forward seating surface is aligned with the deck when the seat is in the forward-facing configuration and wherein the aft seating surface is aligned with the deck when the seat is in the aft-facing configuration;

and wherein a position of the seat axis relative to the platform is fixed.

25. A reversible seat system for a boat, the reversible seat system comprising:

a platform configured to be attached to a deck of a boat; and a seat supported above a deck of the boat by the platform, the seat configured to move between a forward-facing configuration and an aft-facing configuration, wherein the seat rotates about a seat axis when moving between the forward-facing configuration and the aft-facing configuration, wherein a position of the seat axis relative to the platform is fixed, wherein the seat comprises a forward seating surface and an aft seating surface, wherein the forward seating surface is aligned with the deck when the seat is in the forward-facing configuration and wherein the aft seating surface is aligned with the deck when the seat is in the aft-facing configuration;

wherein, when the seat is in the forward-facing configuration, a seating height of the forward seating surface above a deck on which the platform is mounted is greater than a seating height of aft seating surface when the seat is in the aft-facing configuration;

wherein, when the seat is in the forward-facing configuration, the seat axis is located between the forward seating surface and the deck, and wherein the aft seating surface is located below the seat axis when the seat is in the aft-facing configuration.

26. A system according to claim 25, wherein the forward seating surface and the aft seating surface meet at a seating surface junction, wherein the forward seating area comprises a leading edge located distal from the seating surface junction, and wherein the seat axis is located closer to the leading edge of the forward seating surface than the seating surface junction.

27. A system according to claim 15, wherein a position of the seat axis relative to the seat is fixed.

* * * * *